US009648685B2

(12) United States Patent
Toivola

(10) Patent No.: US 9,648,685 B2
(45) Date of Patent: May 9, 2017

(54) METHOD AND APPARATUS FOR DRIVING A LED WITH PULSES

(75) Inventor: Timo Toivola, Turku (FI)

(73) Assignee: Nokia Technologies Oy, Espoo (FI)

( * ) Notice: Subject to any disclaimer, the term of this patent is extended or adjusted under 35 U.S.C. 154(b) by 489 days.

(21) Appl. No.: 13/516,217

(22) PCT Filed: Dec. 18, 2009

(86) PCT No.: PCT/FI2009/051015

§ 371 (c)(1),
(2), (4) Date: Jun. 14, 2012

(87) PCT Pub. No.: WO2011/073498

PCT Pub. Date: Jun. 23, 2011

(65) Prior Publication Data

US 2012/0249002 A1 Oct. 4, 2012

(51) Int. Cl.
*H05B 37/02* (2006.01)
*H05B 33/08* (2006.01)

(52) U.S. Cl.
CPC ..... *H05B 33/0821* (2013.01)

(58) Field of Classification Search
CPC H05B 33/08; H05B 33/0806; H05B 33/0821; H05B 37/00; H05B 33/0833; H05B 33/0845; H05B 37/02; H05B 37/0281
USPC ..... 315/246, 200 R, 360, 44, 193, 187
See application file for complete search history.

(56) References Cited

U.S. PATENT DOCUMENTS 3,755,697 A 8/1973 Miller
6,724,889 B1 * 4/2004 Giles ..... H04M 1/82 379/377
2002/0158590 A1 * 10/2002 Saito ..... H05B 33/0809 315/291
2003/0057888 A1 3/2003 Archenhold et al.
2003/0117087 A1 6/2003 Barth et al.
2005/0023989 A1 2/2005 Juen
2005/0162100 A1 7/2005 Romano et al.
2007/0188114 A1 8/2007 Lys et al.
2008/0067953 A1 * 3/2008 Kranz ..... 315/291
2009/0179591 A1 * 7/2009 Yang ..... H05B 33/0809 315/307

(Continued)

FOREIGN PATENT DOCUMENTS

CN 101437342 A 5/2009
EP 1526759 A2 4/2005

(Continued)

OTHER PUBLICATIONS

International Search Report and Written Opinion received for corresponding International Patent Application No. PCT/FI2009/051015, dated May 10, 2010, 12 pages.

*Primary Examiner* — Jimmy Vu
*Assistant Examiner* — Henry Luong
(74) *Attorney, Agent, or Firm* — Harrington & Smith

(57) ABSTRACT

A method and an apparatus are provided. The apparatus comprises a power source node; a light-emitting diode; a full-wave rectifier configured to produce unipolar half-waves from an alternative current mains supply connected to the power source node; and a voltage controlled switch configured to drive the light-emitting diode with pulses, each pulse derived from a half-wave, the width of the pulses being inversely proportional to mains supply voltage.

8 Claims, 4 Drawing Sheets

(56) References Cited

U.S. PATENT DOCUMENTS

| | | | | |
|---|---|---|---|---|
| 2011/0193489 | A1* | 8/2011 | Moss | 315/210 |
| 2012/0146529 | A1* | 6/2012 | Campbell | H02M 1/10<br>315/210 |

FOREIGN PATENT DOCUMENTS

| | | | |
|---|---|---|---|
| EP | 1577202 | A2 * | 9/2005 |
| GB | 2449665 | A | 12/2008 |

* cited by examiner

METHOD AND APPARATUS FOR DRIVING A LED WITH PULSES

RELATED APPLICATION

This application was originally filed as PCT Application No. PCT/FI2009/051015 filed Dec. 18, 2009.

FIELD OF THE INVENTION

The exemplary and non-limiting embodiments of this invention relate generally to power sources. The embodiments relate specifically to apparatuses comprising a light-emitting diode as an indicator.

BACKGROUND ART

The following description of background art may include insights, discoveries, understandings or disclosures, or associations together with disclosures not known to the relevant art prior to the present invention but provided by the invention. Some such contributions of the invention may be specifically pointed out below, whereas other such contributions of the invention will be apparent from their context.

Power sources, chargers and other units connected to main supplies are sometimes equipped with a light-emitting diode (LED) for indicating when the device is connected to a mains outlet and powered. A lit indicator encourages the user to switch the apparatus off or disconnect it from the mains outlet when not in use.

However, a LED is consuming standby energy if the user leaves the device on continuously. If the power for the LED is taken from the power source output, the power consumption is not negligible. A LED needs only few milliwatts for its operation, but power supply efficiency is extremely low with a small load. Thus, a LED may take several times the nominal power from the mains supply. If the LED is placed in the primary side of the power source or charger, the energy loss is still not negligible as a regulator is needed to provide the LED with a constant current. In solutions designed for low standby power, an X-capacitor supply is commonly used. However, especially on multivoltage power supplies the LED power stabilization is not power-efficient.

SUMMARY

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

An aspect of the invention relates to an apparatus, comprising a power source node; a light-emitting diode; a full-wave rectifier configured to produce unipolar half-waves from an alternative current mains supply connected to the power source node; and a voltage controlled switch configured to drive the light-emitting diode with pulses, each pulse derived from a half-wave, the width of the pulses being inversely proportional to mains supply voltage.

A further aspect of the invention relates to a method, comprising producing unipolar half-waves from the voltage of an alternative current mains supply connected to a power source node; driving a light-emitting diode with pulses, each pulse derived from a half-wave, the width of the pulses being inversely proportional to the mains supply voltage.

A further aspect of the invention relates to an apparatus, comprising a power source node; a light-emitting diode; means for producing unipolar half-waves from an alternative current mains supply connected to the power source node; and means for driving the light-emitting diode with pulses, each pulse derived from a half-wave, the width of the pulses being inversely proportional to mains supply voltage.

Although the various aspects, embodiments and features of the invention are recited independently, it should be appreciated that all combinations of the various aspects, embodiments and features of the invention are possible and within the scope of the present invention as claimed.

BRIEF DESCRIPTION OF THE DRAWINGS

In the following the invention will be described in greater detail by means of exemplary embodiments with reference to the attached drawings, in which.

DETAILED DESCRIPTION OF SOME EMBODIMENTS

Figure 1:
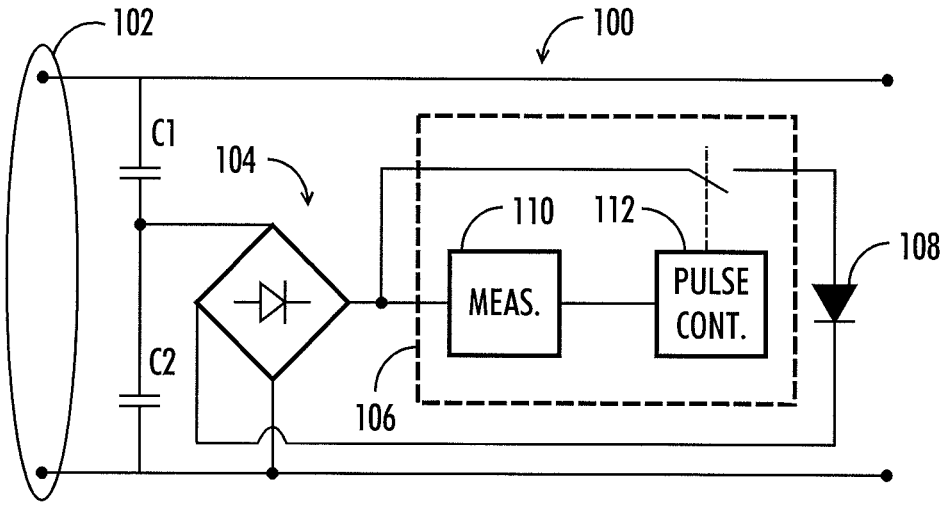
FIG. 1 shows a simplified block diagram illustrating exemplary apparatus.

Exemplary embodiments of the present invention will now be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments. Like reference numerals refer to like elements throughout.

Embodiments of invention are applicable to power sources, chargers and other devices comprising a light-emitting diode indicator. FIG. 1 is a block diagram of an apparatus according to an embodiment of the invention.

The apparatus 100 comprises a power source node 102. An alternative current (AC) mains supply may be operatively or directly connected to the power source node. In an embodiment, the power source node may be configured to receive mains supply voltages of a given voltage range. Thus, it may be called a multivoltage node. Non-limiting examples of possible voltage ranges are 90 to 230 V, 100 to 240 V and 115 to 240V. The actual minimum and maximum values of the voltage range are not relevant regarding the embodiments of the invention.

The apparatus further comprises a full-wave rectifier 104 operatively connected to the power supply node. In an embodiment, the apparatus comprises a voltage divider between the rectifier 104 and the power source node 102. In this example, the divider comprises an X-capacitor C1 and a capacitor C2 connected in series. As the divider is capacitive it does not consume power from power supply node.

The rectifier 104 is the configured to utilize both half-waves provided by the alternative current mains supply connected to the power source node and produce unipolar half-waves.

The apparatus further comprises a voltage controlled switch 106 and a light-emitting diode 108 The voltage controlled switch is configured to measure the output voltage of the rectifier and drive the light-emitting diode with pulses, each pulse being derived from a half-wave and the width of the pulses being inversely proportional to the value of the mains supply voltage. Thus, if the mains voltage is low or near the minimum of the voltage range, the widths of the pulses driving the LED are large and if the mains voltage is high or near the maximum of the voltage range, the widths of the pulses driving the LED are smaller.

In an embodiment, if the mains voltage is low or near the minimum of the voltage range, the widths of the pulses driving the LED may be equal to the width of a half-wave. Thus, a current flows through the LED 100% of the time.

In an embodiment, if the mains voltage is high or near the maximum of the voltage range, the widths of the pulses driving the LED may be equal to quarter of the width of a half-wave. Thus, a current flows through the LED 25% of the time.

In the first case, the LED is conductive most of the time and emits light substantially continuously. In the second case, the LED is in conductive state only approximately 25% of the time, but as the current On/Off frequency is 100 Hz or 120 Hz, the light emitted by the LED is seen as continuous by a human eye, although in reality the LED is not constantly emitting light.

A person skilled in the art will appreciate that this example embodiment will provide a light-emitting diode indicator with similar light intensity throughout the supply voltage range.

In an embodiment, the voltage controlled switch 106 is configured to control the pulse widths linearly over a given mains supply voltage range.

In an embodiment, the voltage controlled switch 106 comprises a voltage measurement circuitry 110 having as an input the unipolar half-waves generated by the full-wave rectifier and a pulse width controller 112. The voltage measurement circuitry 110 is configured to control the pulse width controller 112 to produce pulses having a width inversely proportional to the mains supply voltage.

Figure 2:
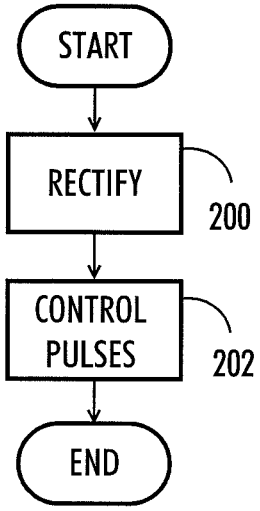
FIG. 2 is a flowchart illustrating an embodiment.

FIG. 2 is a flowchart illustrating an example of an embodiment.

In step 200, unipolar half-waves are produced from the alternative current mains supply.

In step 202, a light-emitting diode is driven with pulses, each pulse derived from a half-wave, the width of the pulses being inversely proportional to the mains supply voltage.

Figure 3A:
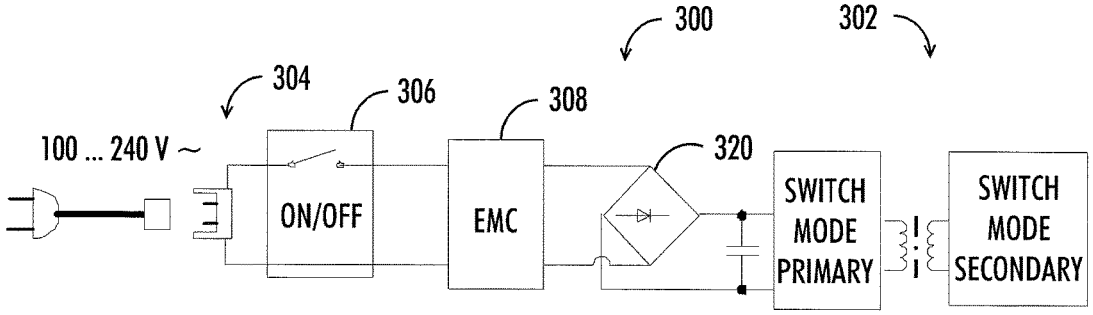
FIGS. 3A and 3B show another block diagrams illustrating exemplary apparatuses.
Figure 3B:
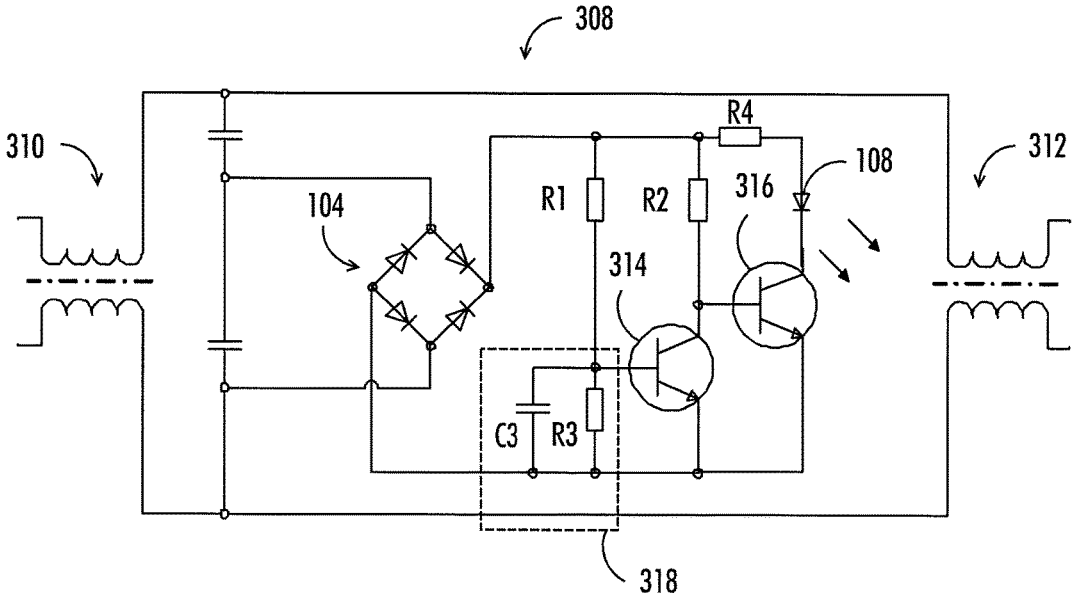

FIGS. 3A and 3B illustrate an example of an apparatus according to an embodiment. FIG. 3A illustrates an example of a device 300 where the apparatus is utilized. The device comprises a transformer 302 and mains supply input 304. Further, the device comprises an on/off switch 306 and a rectifier 320 prior to the transformer 302. In this example, the device comprises an Electromagnetic Compatibility (EMC) unit 308 between the on/off switch and the rectifier. In this example, the apparatus is in connection with the EMC unit. However, it should be noted that the usage of the apparatus is not limited to devise comprising EMC units, transformers, chargers or power supplies. In addition, any numerical values given below are illustrative only.

FIG. 3B illustrates an example of an apparatus 308. The apparatus 308 comprises a LED 108. The components of the apparatus may be selected such that any type of light-emitting diode may be used. Examples of commonly available LED types are all semiconductor based light-emitting diodes, including for instance organic light-emitting diodes (OLED). The value for the resistor R1 may be selected on the basis of the LED threshold voltage. The resistor R4 of a small value may be optionally used to limit the LED current.

In an embodiment, the apparatus comprises a common mode coil 310 at the main supply input to remove possible interference in mains supply. In addition, the apparatus may comprise a second common mode coil 312. However, the coils are not relevant considering embodiments of the invention.

In an embodiment, the apparatus comprises a voltage divider realized with a line-to-line capacitor C1 (a so called X-capacitor) and a capacitor C2 connected in series. An X-capacitor is commonly used in devices connected to mains supplies as an AC (alternate current) input filter to provide protection for radio frequency interference. As the divider is capacitive it does not consume power from the power supply. The divider reduces differential interferences. In an embodiment, the value of C1 is approximately from ten to a few hundred nanofarads and C2 is of the order of a few μF.

A full-wave rectifier 104 is connected to the mains supply via the voltage divider. In this example, the switching of the LED current is realized with two transistors 314, 316. The transistors in this example are bipolar NPN transistors. One skilled in the art is aware that the type of transistors is not relevant. For example, field effect transistors (FET) may also be used.

The apparatus comprises an RC circuit formed by resistors R1 and R3 and capacitor C3. In this example, a voltage divider formed by resistors R1 and R3 is used to feed current to the base of the first transistor 314 and to charge the capacitor C3. At first, the transistor 314 is in a cutoff state. The base voltage of the second transistor 316 is high and the transistor is in conductive state. Thus, a current flows through the LED and the LED emits light. If the unipolar half-wave current supplied through the resistor R1 is high enough to charge the capacitor C3 so that the voltage over the capacitor reaches the base voltage of the transistor 314, the transistor is switched to a conductive state. Thus, the base voltage of the second transistor 316 drops and the transistor is switched to a cutoff state. This causes the LED current to cease and the LED becomes nonconducting.

The above arrangement is configured to control the amount of current flowing through the LED 108 to be approximately equal on average over time regardless of the mains supply voltage. Thus, approximately the same amount of energy is transformed to light in the LED with all supply voltages within the given voltage range. The RC-circuit 318 may be designed to operate in a desired manner with different mains supply voltages by selecting the values of resistors R1 and R3 and the capacitor C3 appropriately to create a desired time constant for biasing the transistor 314.

Figure 4:
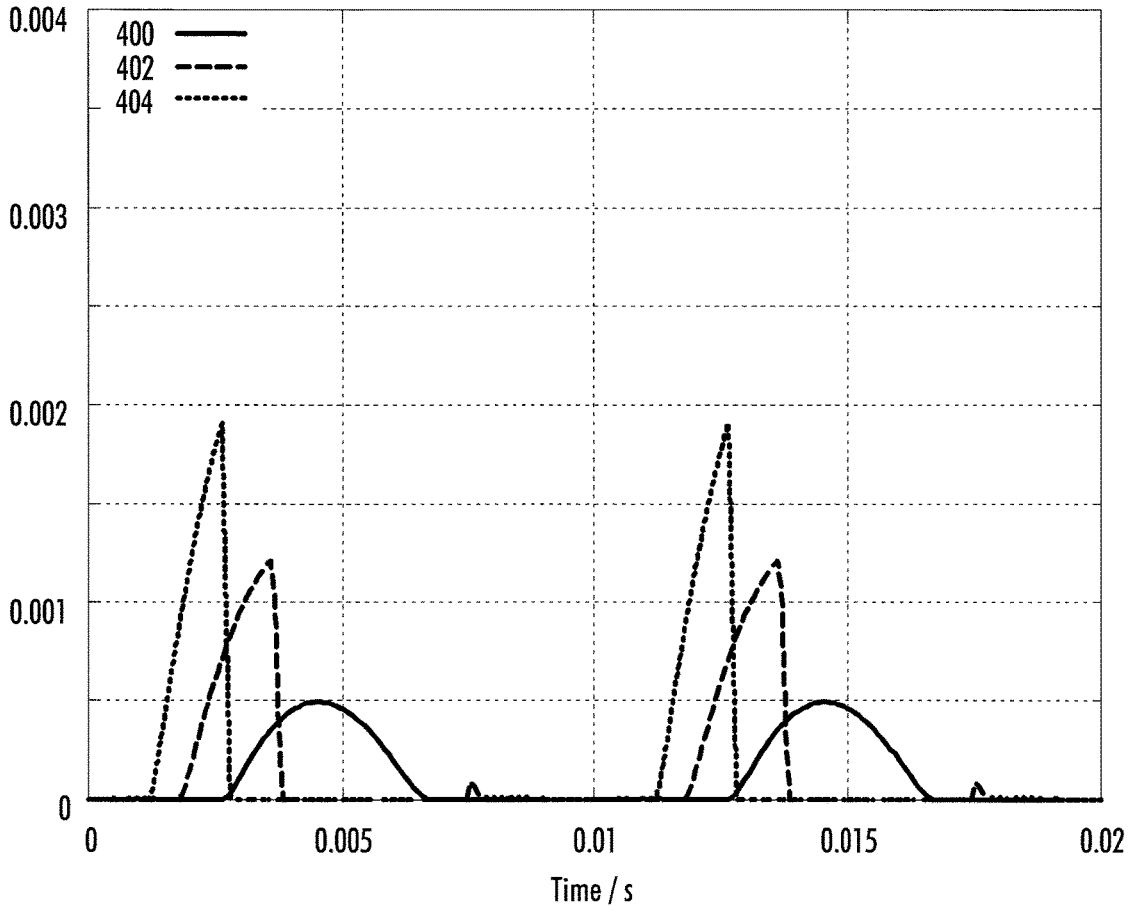
FIG. 4 illustrates examples of current through a light-emitting diode with different mains voltages.

FIG. 4 illustrates examples of the current through the LED 108 with different mains voltages. FIG. 4 shows the current through the LED when the mains supply is 115 V (line 400), 160 V (line 402) and 230 V (Line 404). Time is on x-axis and current (in amperes) on y-axis. As FIG. 4 illustrates, the instantaneous current is higher with a higher supply voltage. However, the graphical integral (the area between the current curve and the x-axis representing time) may be configured to be substantially equal in the given voltage range. Therefore, the light intensity with different supply voltages is substantially the same with properly designed component values.

Figure 5A:
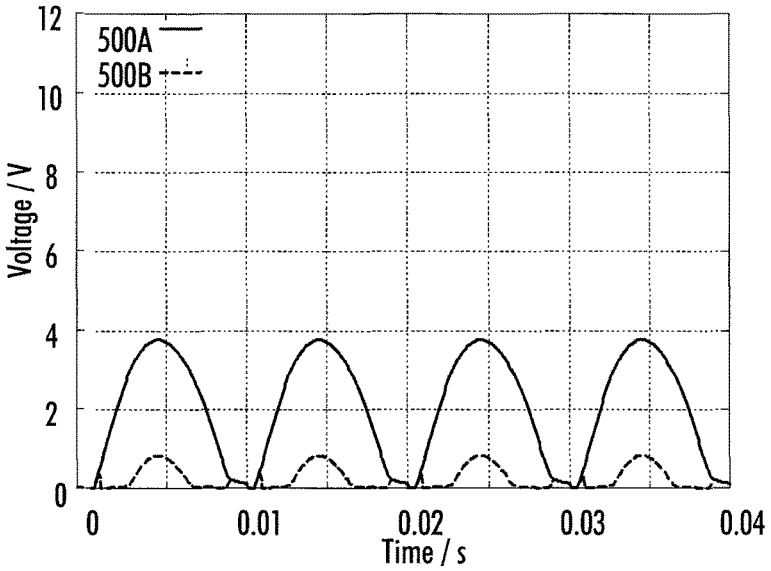
FIGS. 5A, 5B and 5C illustrate examples of voltages at the terminals of a light-emitting diode with different mains voltages.
Figure 5B:
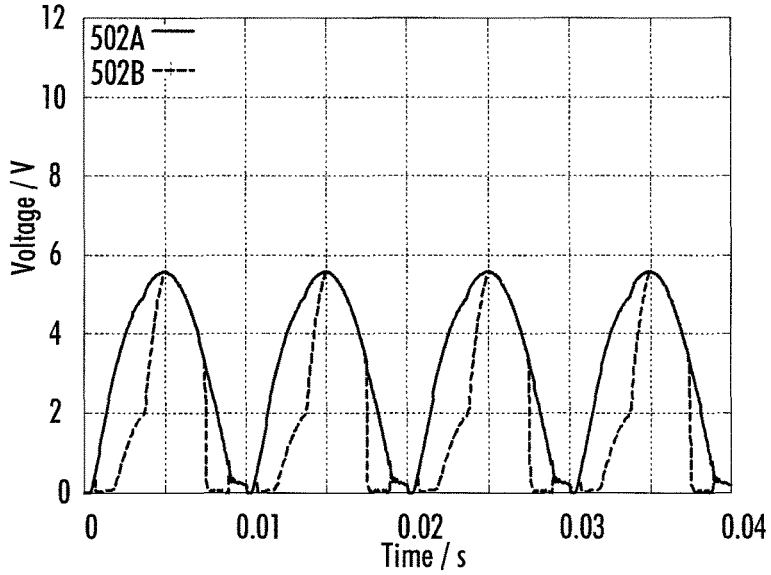
Figure 5C:
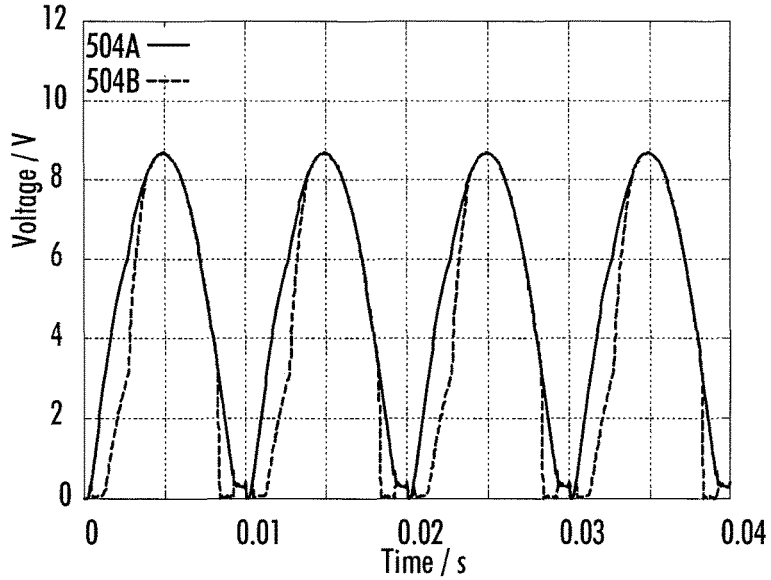

FIGS. 5A to 5C illustrate examples of voltages at the terminals of the LED 108 with different mains voltages.

FIG. 5A illustrates a case where the mains supply voltage is 115V. The figure shows the half-waves 500A at the rectifier output, and the voltage 500B on the LED cathode. As the FIG. 5A and line 400 of FIG. 4 show, the LED is in conductive state during the most of the width of each half-wave.

FIG. 5B illustrates a case where the mains supply voltage is 160V. The figure shows the half-waves 502A at the rectifier output, and the voltage 502B on the LED cathode. As the FIG. 5B and line 402 of FIG. 4 show, the LED is in conductive state about half of the duration of the half-waves. The circuit limits the current through the LED.

Respectively, FIG. 5C illustrates a case where the mains supply voltage is 230V. The lines 504A, 504B and line 404 of FIG. 4 illustrate how the LED is in conductive state only about a quarter of the duration of the half-waves.

The proposed solution limits the power consumption of the LED driver efficiently with high supply voltage values. Thus, a charger or power supply equipped with the apparatus may easily fulfill low standby power requirements. The LED intensity is nearly the same with all main supply voltages. If the apparatus is equipped with a turn On/Off mains switch, the LED turns instantly on when the circuit is powered on. Likewise, the LED turns off immediately as the power is cut off.

The apparatus is easy to realize with simple components. In an embodiment, the apparatus may be realized as one LED driver component, or integrated inside a LED unit.

The techniques described herein may be implemented by various means so that an apparatus implementing one or more functions of a corresponding entity described with an embodiment comprises not only prior art means, but also means for implementing the one or more functions of a corresponding apparatus described with an embodiment and it may comprise separate means for each separate function, or means may be configured to perform two or more functions.

It will be obvious to a person skilled in the art that, as technology advances, the inventive concept can be implemented in various ways. The invention and its embodiments are not limited to the examples described above but may vary within the scope of the claims.

The invention claimed is:

1. An apparatus, comprising
a power source node;
a light-emitting diode;
a full-wave rectifier comprised of diodes and configured to produce unipolar half-waves from the alternative current mains supply connected to the power source node; and
a voltage controlled switch comprised of discrete electronic circuit elements comprising of
an RC circuit formed of at least one resistor and a capacitor, and
a first transistor and a second transistor;
wherein the RC circuit and the first transistor and the second transistor is configured to drive the light-emitting diode with voltage pulses that cause the light-emitting diode to be in a conductive state for a portion of the voltage pulses, each voltage pulse derived from a half-wave generated by the full-wave rectifier,
wherein the voltage controlled switch is configured to cause, based on the voltage pulses, a time period of each conductive state to be inversely proportional to mains supply voltage throughout a voltage range of the mains supply whereby power applied to the light-emitting diode during each voltage pulse is dependent on the time period and the mains supply voltage so that a light intensity of the light-emitting diode is similar throughout the voltage range.

2. The apparatus of claim 1, wherein maximum instantaneous currents for the time periods are higher for higher voltages of the main supply, and wherein voltage controlled switch is configured to control, based on the voltage pulses, the conductive states to provide equal amount of current on average over time through the light-emitting diode regardless of the mains supply voltage.

3. The apparatus of claim 1, further comprising: a voltage divider between the rectifier and the power source node, the divider comprising an x-capacitor and a capacitor connected in series.

4. The apparatus of claim 1, wherein the voltage controlled switch comprises a voltage measurement circuitry having as an input the unipolar half-waves generated by the full-wave rectifier and a pulse width controller, and wherein the voltage measurement circuitry is configured to control the pulse width controller to cause, based on the voltage pulses, the time period of each conductive state to be inversely proportional to the mains supply voltage throughout the voltage range of the mains supply.

5. A method, comprising
producing, by an apparatus, comprising a full-wave rectifier comprised of diodes, unipolar half-waves from voltage of an alternative current mains supply connected to a power source node; and
driving, by the apparatus, comprising a voltage controlled switch comprised of discrete electronic circuit elements comprising
an RC circuit formed of at least one resistor and a capacitor, and
a first transistor and a second transistor;
a light-emitting diode with voltage pulses that cause the light-emitting diode to be in a conductive state for a portion of the voltage pulses, each voltage pulse derived from a half-wave generated by the full-wave rectifier, wherein the voltage controlled switch is configured to cause, based on the voltage pulses, a time period of each conductive state to be inversely proportional to the mains supply voltage throughout a voltage range of the mains supply whereby power applied to the light-emitting diode during each voltage pulse is dependent on the time period and the mains supply voltage so that a light intensity of the light-emitting diode is similar throughout the voltage range.

6. The method according to claim 5, wherein maximum instantaneous currents for the time periods are higher for higher voltages of the main supply, the method further comprising: controlling, by the apparatus, based on the voltage pulses, the conductive states to provide equal amount of current on average over time through the light-emitting diode regardless of the mains supply voltage.

7. The method according to claim 5, further comprising: dividing, by the apparatus, the voltage of the alternative current mains supply with a voltage divider prior to the production of the unipolar half-waves, the divider comprising an x-capacitor and a capacitor connected in series.

8. An apparatus, comprising a power source node;

a light-emitting diode;

means comprising a full-wave rectifier comprised of diodes for producing unipolar half-waves from an alternative current mains supply connected to the power source node; and means comprising a voltage controlled switch comprised of discrete electronic circuit elements comprising an RC circuit formed of at least one resistor and a capacitor, and a first transistor and a second transistor;

for driving the light-emitting diode with voltage pulses, each voltage pulse derived from a half-wave generated by the discreet electronic element diodes, wherein the means for driving causes, based on the voltage pulses, a time period of each conductive state to be inversely proportional to mains supply voltage throughout a voltage range of the mains supply whereby power applied to the light-emitting diode during each voltage pulse is dependent on the time period and the mains supply voltage so that a light intensity of the light-emitting diode is similar throughout the voltage range.

* * * * *